US008401456B2

(12) United States Patent
Kano

(10) Patent No.: US 8,401,456 B2
(45) Date of Patent: Mar. 19, 2013

(54) MEDIUM HOLDING APPARATUS AND IMAGE FORMING APPARATUS THAT EMPLOYS THE MEDIUM HOLDING APPARATUS

(75) Inventor: Hiromi Kano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1164 days.

(21) Appl. No.: 12/237,090

(22) Filed: Sep. 24, 2008

(65) Prior Publication Data

US 2009/0080957 A1 Mar. 26, 2009

(30) Foreign Application Priority Data

Sep. 26, 2007 (JP) ..... 2007-249478

(51) Int. Cl.
*G03G 15/00* (2006.01)
*B65H 1/00* (2006.01)
*B41J 13/10* (2006.01)

(52) U.S. Cl. ..... 399/393; 399/392; 271/9.09

(58) Field of Classification Search ..... 399/392, 399/393; 271/9.09
See application file for complete search history.

(56) References Cited

U.S. PATENT DOCUMENTS 5,421,570 A * 6/1995 Hube et al. ..... 271/145
6,776,410 B2 * 8/2004 Fukuda ..... 271/207
6,916,020 B2 * 7/2005 Hasegawa ..... 271/171
2004/0012141 A1 * 1/2004 Hara et al. ..... 271/145
2004/0085426 A1 * 5/2004 Cuyler, Jr. ..... 347/104
2006/0232000 A1 * 10/2006 Takahashi et al. ..... 271/145

FOREIGN PATENT DOCUMENTS

JP 57158856 A * 9/1982
JP 02175546 A * 7/1990
JP 06179529 A * 6/1994
JP 2002362786 A * 12/2002
JP 2003054767 A * 2/2003
JP 2003341907 A * 12/2003
JP 2004-091211 3/2004
JP 2004196496 A * 7/2004
JP 2006062183 A * 3/2006

OTHER PUBLICATIONS

Machine Translation of JP 2004196496 A, JPO, Oct. 24, 2011.*

* cited by examiner

*Primary Examiner* — Matthew G Marini
*Assistant Examiner* — Nguyen Q Ha
(74) *Attorney, Agent, or Firm* — Rabin & Berdo, P.C.

(57) ABSTRACT

A medium holding apparatus detachably is attached to a medium feeding section of an image forming apparatus. A supporting section supports the medium thereon. A side guide is mounted to the supporting section. The side guide extends in a direction parallel to a first direction in which the medium is advanced to the medium feeding section, and is movable in a second direction substantially perpendicular to the first direction. The side guide abuts the side edge of the medium to guide the medium toward the medium feeding section. A guide unit is mounted to the supporting section, and holds the medium in a gently curved position. When the medium is fed to the image forming apparatus, the guide unit guides the medium to the supporting section.

16 Claims, 17 Drawing Sheets

MEDIUM HOLDING APPARATUS AND IMAGE FORMING APPARATUS THAT EMPLOYS THE MEDIUM HOLDING APPARATUS

BACKGROUND OF THE INVENTION

1. Field of the Invention

The present invention relates to a medium holding apparatus and an image forming apparatus that employs the medium holding apparatus.

2. Description of the Related Art

Conventional electrophotographic image forming apparatuses include printers, facsimile machines, and multi function printers (MFPs), and employ an electrophotographic image forming process. Japanese Patent Publication No. 2004-91211A discloses one such electrophotographic image forming apparatus. A charging roller uniformly charges the surface of a photoconductive drum. An LED head illuminates the charged surface to form an electrostatic latent image. A developing roller supplies toner to the electrostatic latent image to form a toner image. A transfer roller transfers the toner image onto paper. A fixing unit fixes the toner image on the paper. A cleaning blade scrapes residual toner off the photoconductive drum after transfer.

SUMMARY OF THE INVENTION

The invention is intended to provide a medium holding apparatus in which paper is placed accurately in position.

The invention is intended to provide an image forming apparatus that employs the medium holding apparatus in which paper is placed accurately in position.

The present invention provides a medium holding apparatus detachably attached to a medium feeding section of an image forming apparatus. A supporting section supports the medium thereon. A side guide is mounted to the supporting section. The side guide extends in a direction parallel to a first direction in which the medium is advanced to the medium feeding section, and is movable in a second direction substantially perpendicular to the first direction. The side guide abuts the side edge of the medium to guide the medium toward the medium feeding section. A guide unit is mounted to the supporting section, and holds the medium in a gently curved position. When the medium is fed to the image forming apparatus, the guide unit guides the medium to the supporting section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Embodiments of the invention will be described in detail with reference to the accompanying drawings. The invention will be described in terms of a printer.

Figure 1:
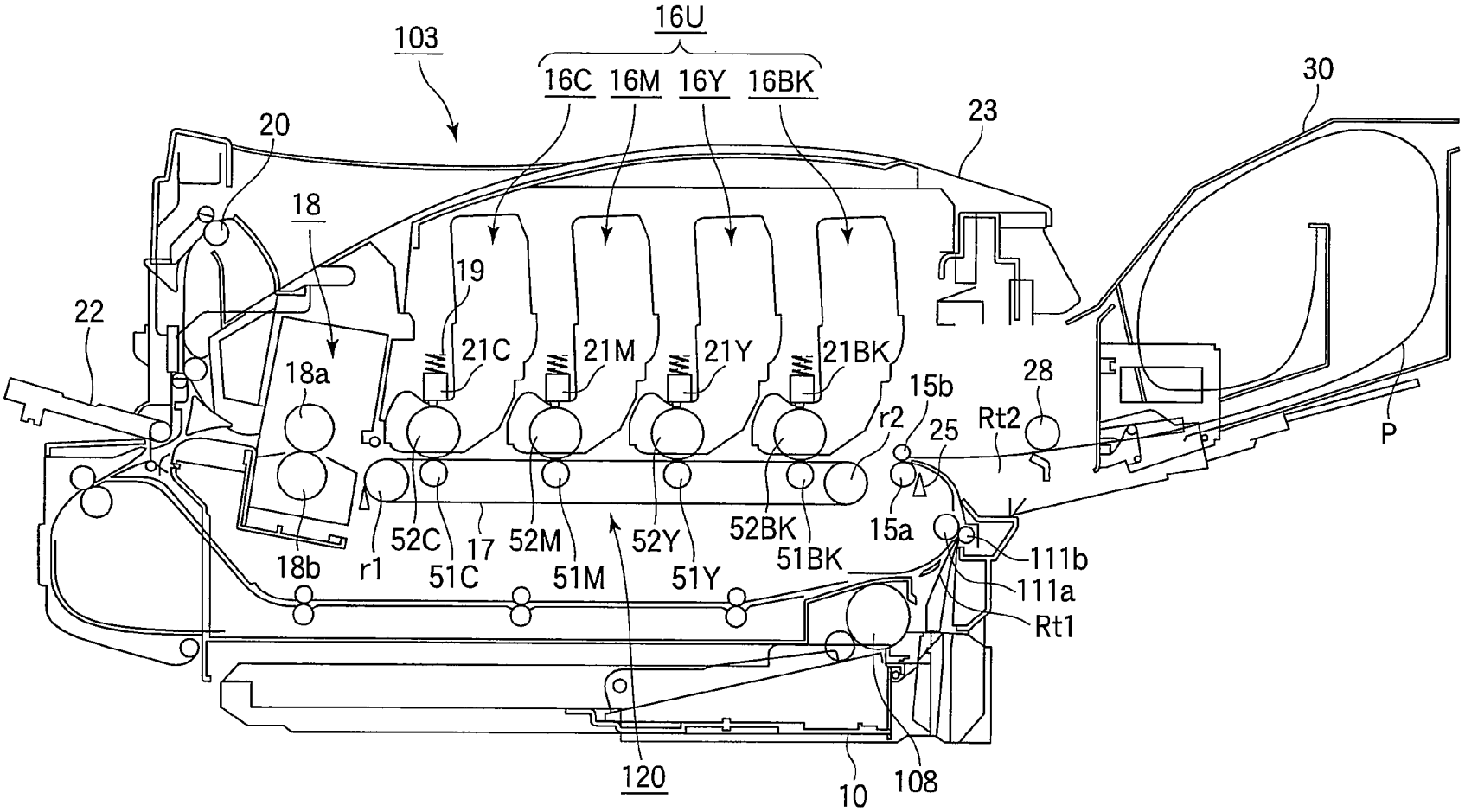
FIG. 1 illustrates a general configuration of a printer of a first embodiment.

FIG. 1 illustrates a general configuration of a printer of a first embodiment.

Referring to FIG. 1, a paper cassette 10 holds a stack of regular size paper. A medium tray 30 is detachably attached to the body 103, and holds a stack of long size paper P. An image forming section 16U forms black, yellow, magenta, and cyan toner images. A transfer unit 120 is disposed beneath the image forming section 16U. LED heads 21BK, 21Y, 21M, and 21C are disposed over the image forming section 16U. A fixing device 18 is disposed downstream of the image forming section 16U with respect to travel of paper.

A hopping roller 108 is disposed at the exit of the cassette 10, and feeds the paper from the cassette 10 on a page-by-page basis to a transport path Rt1. A registry roller 111*a* and a pressure roller 111*b* are disposed downstream of the hopping roller 108, and transport the paper P through the transport path Rt1. A registry roller 15*a* and a pressure roller 15*b* are disposed downstream of the registry roller 111*a* and pressure roller 111*b*, and further transport the paper P through the transport path Rt1 to the image forming section 16U. The hopping roller 108, registry roller 111*a*, and pressure roller 111*b* cooperate to constitute a first medium feeding section.

A feed roller 28 is disposed adjacent the medium tray 30 and feeds the paper P into a transport path RT2. A paper sensor 25 is disposed downstream of the feed roller 28, and detects the leading edge of the paper P.

The image forming section 16U includes image forming units 16BK, 16Y, 16M, and 16C. The LED heads 21BK, 21Y, 21M, and 21C are mounted to an upper cover 23, and are urged by springs 19 against the image forming units 16BK, 16Y, 16M, and 16C, respectively.

Charging rollers (not shown) uniformly charge the surfaces of photoconductive drums 52BK, 52Y, 52M, and 52C. Developing rollers (not shown) supply toners to corresponding photoconductive drums 52BK, 52Y, 52M, and 52C to form toner images of corresponding colors. Toner supplying rollers (not shown) each supply the toner to a corresponding developing roller. Developing blades (not shown) each form a thin layer of toner on the corresponding developing rollers. Cleaning devices (not shown) scrape residual toner off the corresponding photoconductive drums 52BK, 52Y, 52M, and 52C. An ID motor (not shown) drives the photoconductive drums 52BK, 52Y, 52M, and 52C in rotation.

The transfer unit 120 includes a drive roller r1, an idle roller r2, a transport belt 17, transfer rollers 51BK, 51Y, 51M, and 51C, and a belt motor. The transport belt 17 is disposed about the drive roller r1 and idle roller r2. The transfer rollers 51BK, 51Y, 51M, and 51C parallel the photoconductive drums 52BK, 52Y, 52M, and 52C. The belt motor drives the drive roller r1 in rotation, causing the transfer belt 17 to run. A tension roller (not shown) may be added for maintaining the transport belt 17 in tension.

The fixing device 18 includes a fixing roller 18*a* and a pressure roller 18*b*. A fixing motor (not shown) drives the fixing roller 18*a* in rotation. The pressure roller 18*b* is freely rotatable. When the fixing roller 18*a* is driven to rotate, the pressure roller 18*b* rotates in contact with the fixing roller 18*a*. The fixing roller 18*a* incorporates a heater (not shown) therein.

The medium tray 30 is attached to the body 103, and the paper P is loaded in the medium tray 30. When a controller receives a print command from a host apparatus (e.g., personal computer), a feed/transport motor (not shown), disposed over the forward end of the medium tray 30, is energized to drive the feed roller 28 in rotation. Then, the paper P in the medium tray 30 is fed to abut the nip between the registry roller 15*a* and the pressure roller 15*b*, thereby removing the skew of the paper P.

Then, the registry roller 15*a* is rotated to advance the paper P to the image forming section 16U. A spring (not shown) urges the pressure roller 15*b* against the registry roller 15*a* to produce a transporting force.

The belt motor drives the transport belt 17 to run. The transport belt 17 runs with the paper P attracted thereon, passing through transfer points defined between the photoconductive drums 52BK, 52Y, 52M, and 52C and the transfer rollers 51BK, 51Y, 51M, and 51C, so that toner images of the respective colors are transferred one over the other in registration to form a full color toner image.

Subsequently, the paper P is fed to the fixing device 18 where the color toner image is fused into a full color image. Then, the paper P is discharged by a discharge roller 20 onto the upper cover 23.

The medium tray 30 will be described.

Figure 2:
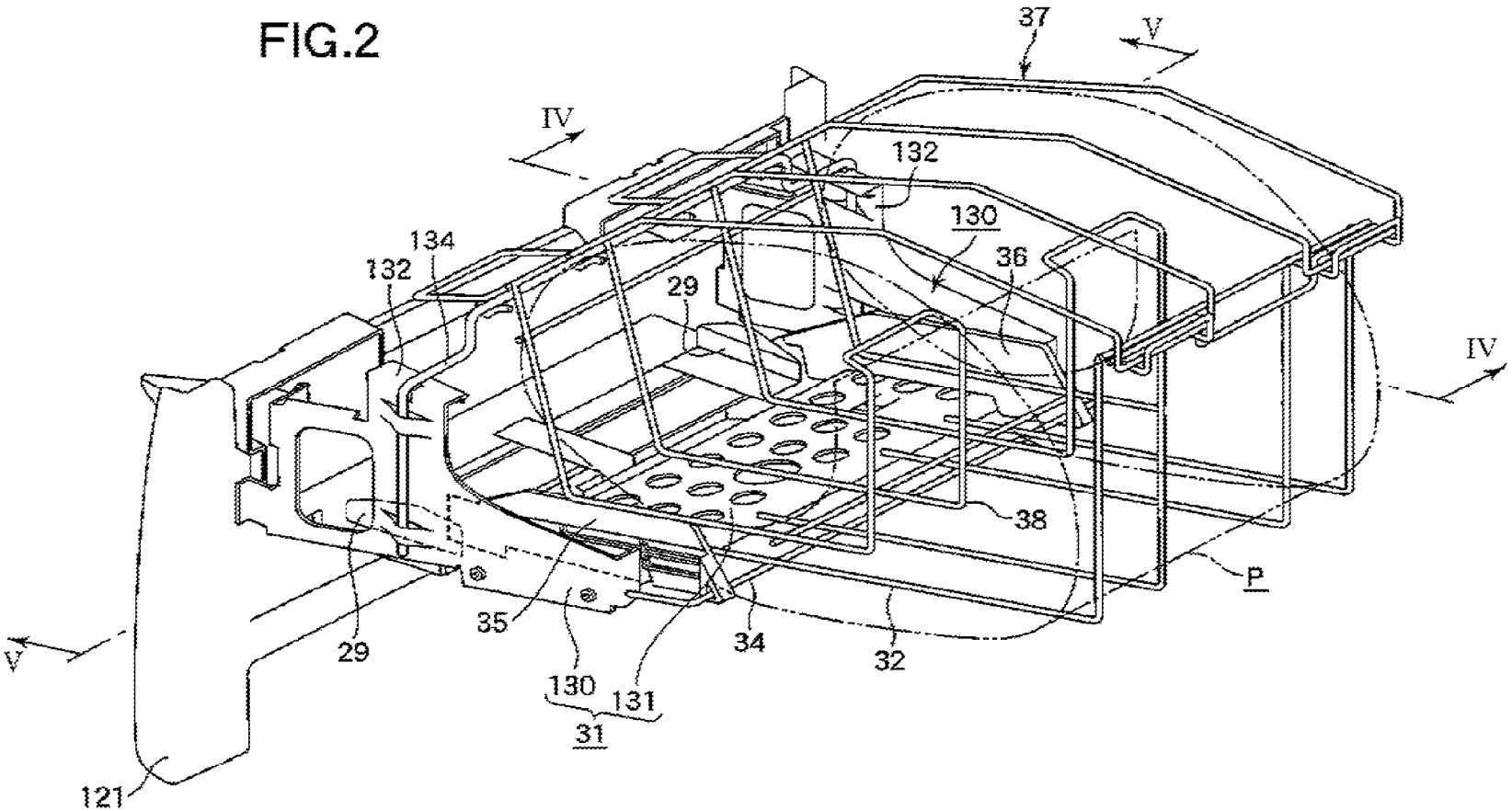
FIG. 2 illus is a perspective view of the medium tray of the first embodiment.

FIG. 2 is a perspective view of the medium tray 30 of the first embodiment.

Figure 3:
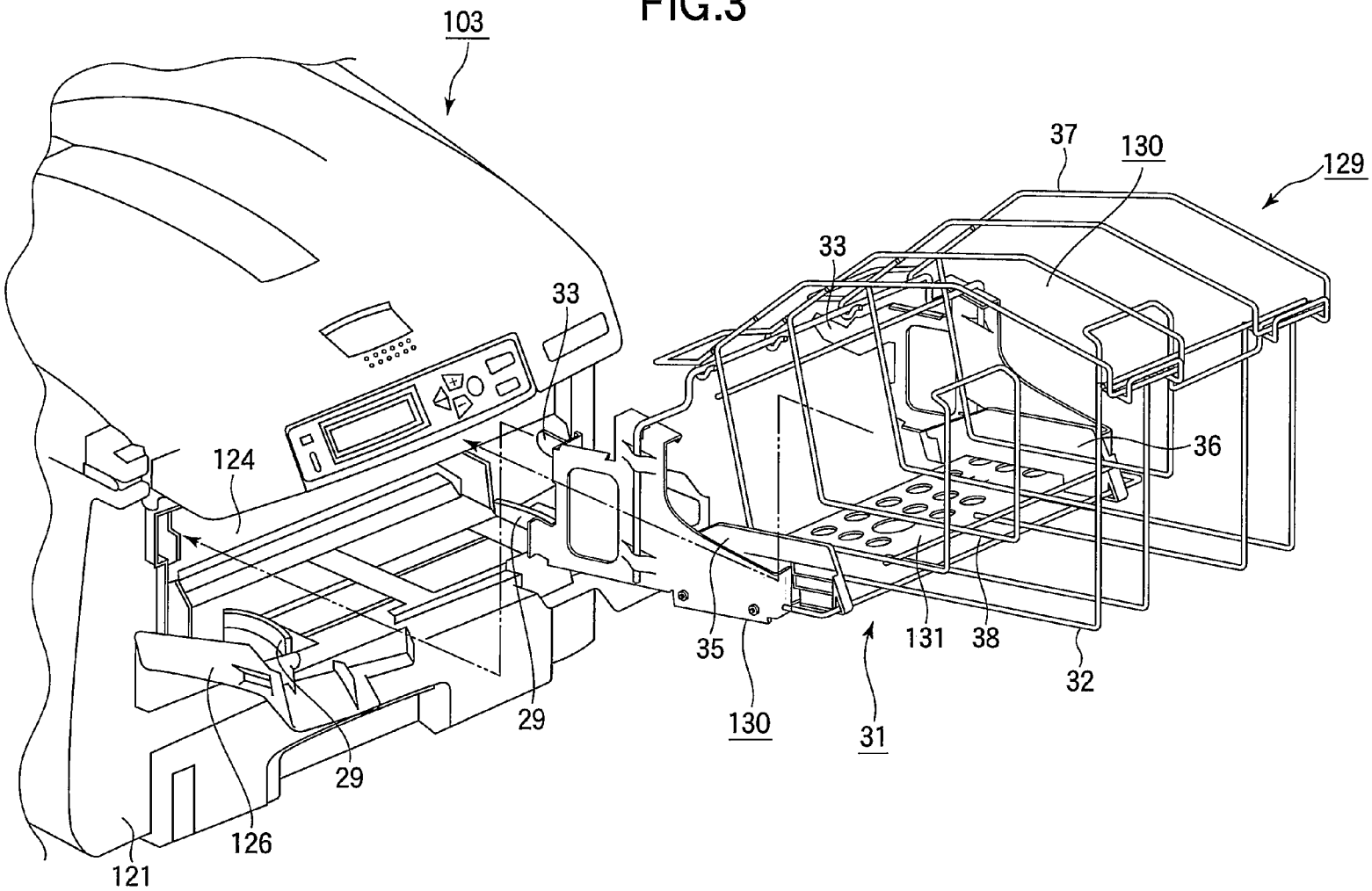
FIG. 3 illustrates how the medium tray 30 is attached to the body.

FIG. 3 illustrates how the medium tray 30 is attached to the body.

Figure 4:
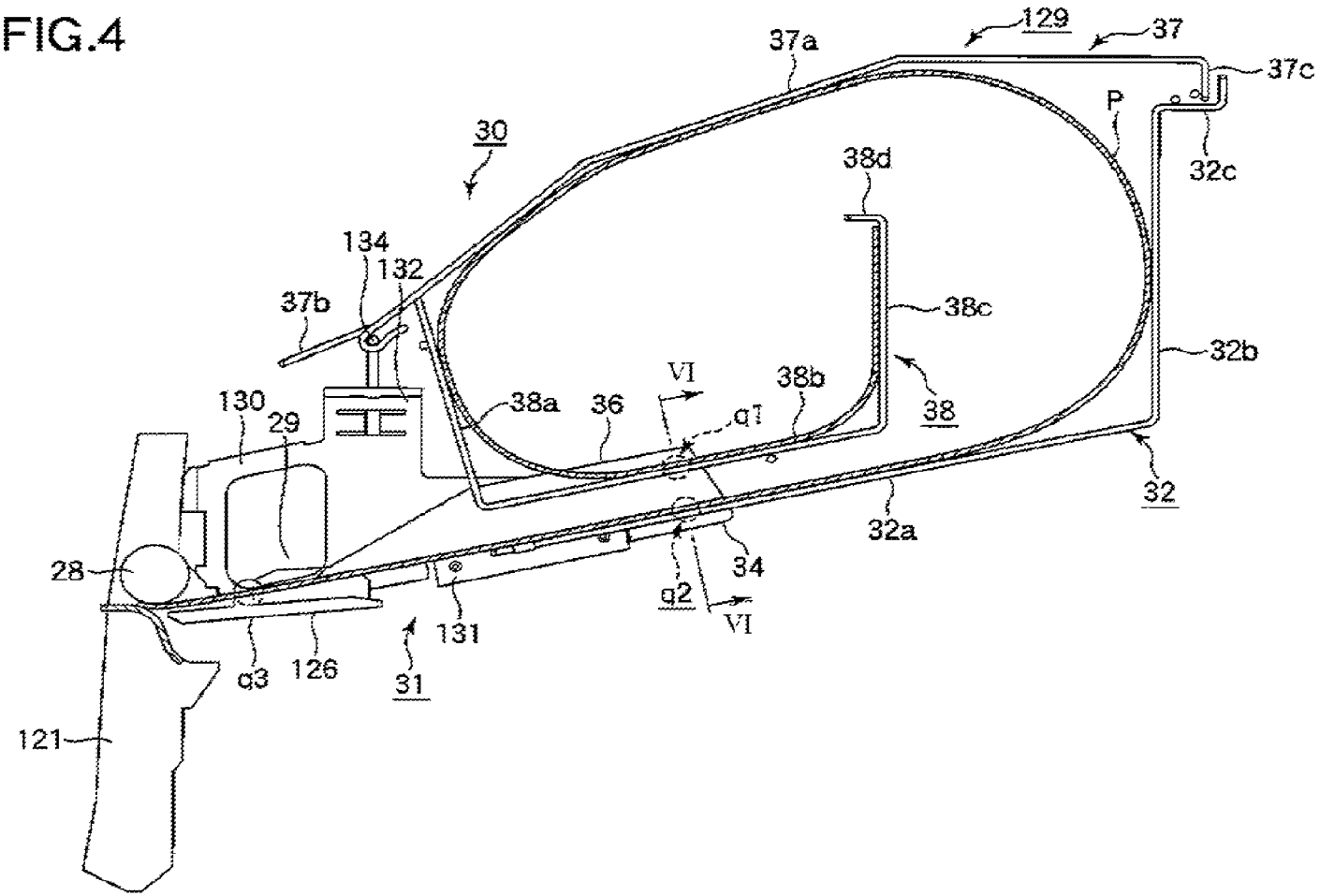
FIG. 4 is a cross-sectional view taken along a line IV-IV of FIG. 2.

FIG. 4 is a cross-sectional view taken along a line IV-IV of FIG. 2.

Figure 5:
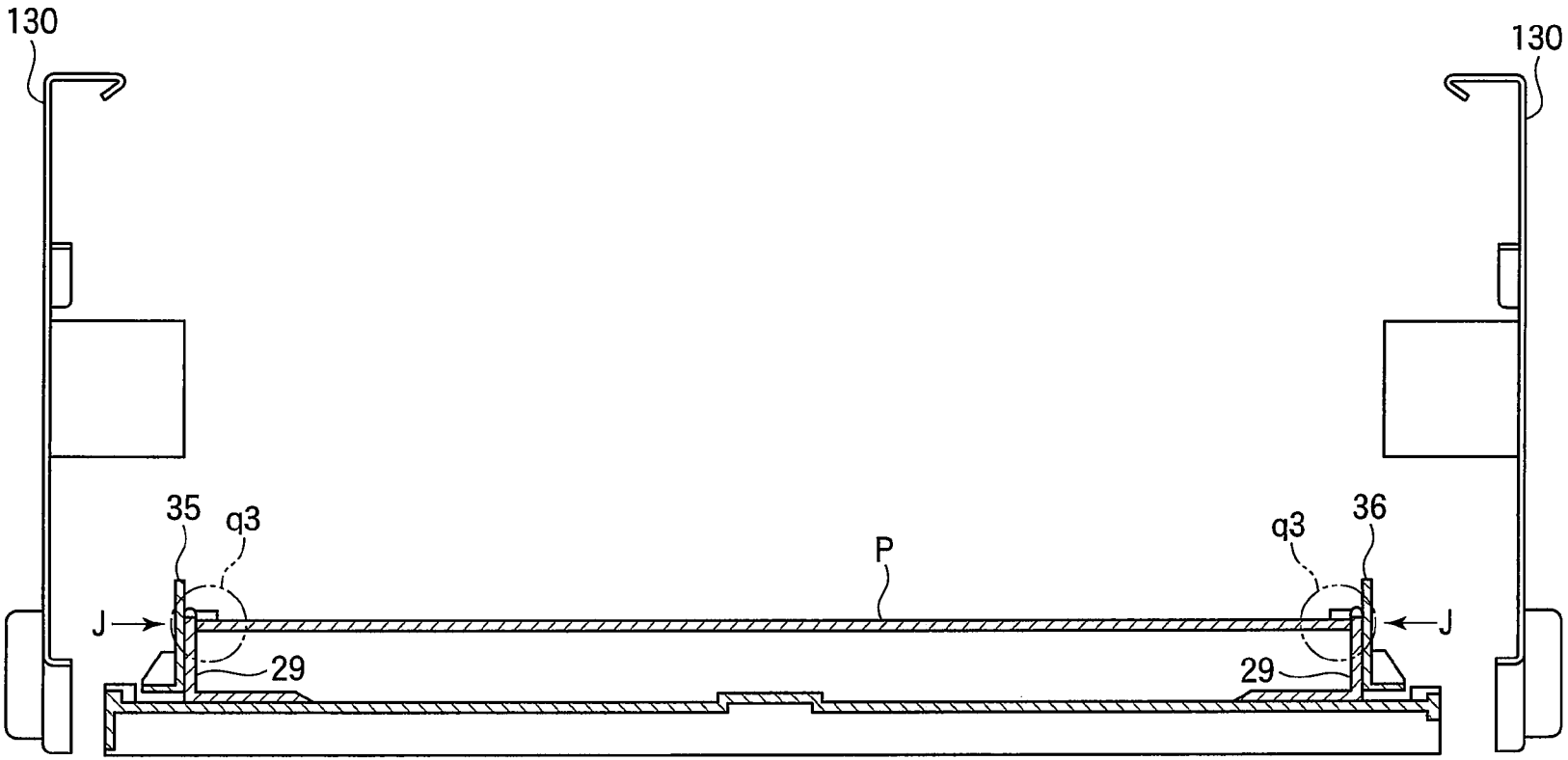
FIG. 5 is a cross-sectional view taken along a line V-V of FIG. 2.

FIG. 5 is a cross-sectional view taken along a line V-V of FIG. 2.

Figure 6:
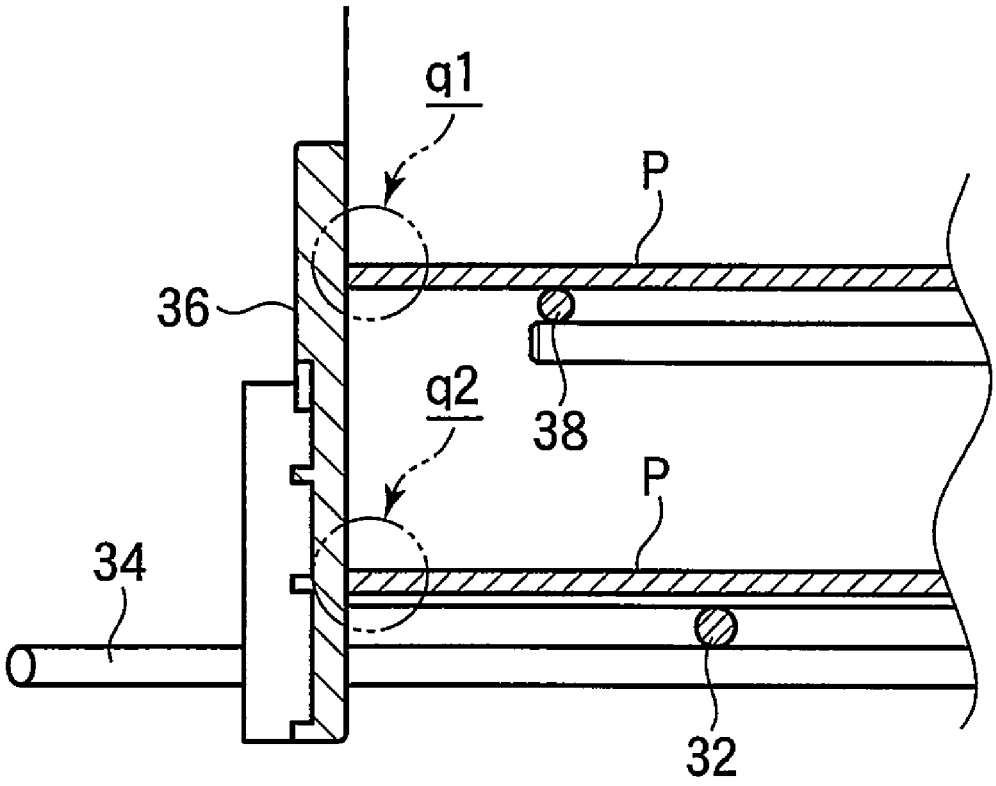
FIG. 6 is a cross-sectional view taken along a line VI-VI of FIG. 5.

FIG. 6 is a cross-sectional view taken along a line VI-VI of FIG. 4.

Referring to FIG. 2, the medium tray 30 is detachably attached to a chassis 121 of the body 103. The chassis 121 includes a mounting opening 124 (FIG. 3) and side covers 126 configured to open and close. The side covers 126 each include a feed guide 29 that extends in a vertical plane and guides the paper P supplied into the body 103. The number of sheets of the paper P loaded at a time in the guide unit 129, for example, 10 sheets. The feed guides 29 are movable in a traverse direction (i.e., a direction perpendicular to the direction of travel of the paper P) so that the feed guides 29 may be adjusted to abut the side edge of the paper P after the medium tray 30 has been attached to the body 103. A second medium feeding section is constituted primarily of the paper sensor 25, feed roller 28, and feed guides 29.

The medium tray 30 includes a medium support 31 and a guide unit 129. The medium support 31 supports the paper P thereon, and guides the paper P into the body 103. The guide unit 129 is mounted to the medium support 31 and supports the paper P thereon such that the paper P is gently curved or curled. When the paper P is fed into the body 103, the guide unit 129 guides the paper P toward the medium support 31.

The medium support 31 includes a pair of brackets 130, a supporting plate 131, a pair of side guides 35 and 36. The brackets 130 are spaced apart by a predetermined distance. The supporting plate 131 includes longitudinal end portions coupled to the brackets 130, and supports the brackets 130 thereon. The side guides 35 and 36 are movable in a traverse direction (i.e., a direction perpendicular to the direction of travel of the paper P), and guide the paper P so that the paper P advances while being guided by the side guides 35 and 36. Hooks 33 are each formed on an upper forward end portion of the bracket 130, projecting forwardly of the bracket 130. As shown in FIG. 3, the medium tray 30 is attached to the body 103 in a direction shown by a dot-dashed line with the hooks 33 inserted into engagement portions (not shown) of the body 103. Each bracket 130 includes a vertically projecting portion 132 to which a metal shaft 134 is mounted. Thus, the metal shaft 134 spans across the brackets 130. A shaft 34 is mounted to the bottom portions of the brackets 130 to span across the brackets 130. The side guides 35 and 36 are pivotal about the shaft 34, and are movable along the shaft 34 in a traverse direction of the paper P (i.e., a direction perpendicular to the direction of travel of the paper P).

The side guides 35 and 36 extend in directions parallel to an advance direction in which the paper P is transported into the body 103, and extend substantially in a vertical plane relative to the supporting plate 131. When the medium tray 30 has been mounted to the body 103, the side guides 35 and 36 are horizontally aligned with each other. The side guides 35 and 36 are movable in directions shown by arrows J while the feed guides 29 are positioned between the side guides 35 and 36. The side guides 35 and 36 abut the feed guides 29 so that the paper P is smoothly guided into the body 103.

The guide unit 129 is formed by bending metal bars into a cage-like structure and by welding at locations as required. The guide unit 129 generally extends rearwardly of the medium support 31. The guide unit 129 is detachably inserted into the supporting plate 131. The guide unit 129 includes a medium rear portion guide 32 and an upper guide 37. The medium read portion guide 32 is detachably inserted into the supporting plate 131, and guides the paper P while supporting the middle portion of the paper P. The upper guide 37 is disposed over the medium support 31, and guides the rear end portion of the paper P.

The medium rear portion guide 32 includes a lower receiving portion 32*a*, a rising portion 32*b*, and a support 32*c*. The lower receiving portion 32*a* extends rearwardly of the supporting plate 131 substantially in a direction parallel to a plane in which the supporting plate 131 generally lies. The rising portion 32*b* extends substantially vertically from a rear end portion of the lower receiving 32*a*, and supports a rear side of the stack of the paper P. The support 32*c* is formed at the upper end portion of the rising portion 32*b*, and supports the rear end of the upper guide 37.

The upper guide 37 includes a retainer 37*a* and a guide 37*b*. The retainer 37*a* is pivotally supported on the shaft 134, and extends away from the body 103 in a direction substantially parallel to the lower receiving portion 32*a*. The guide 37*b* extends forwardly of the retainer 37*a* toward the body 103, preventing the printed paper P from falling onto the feed roller 28 as well as guiding the printed paper P onto the retainer 37*a*. A rear support 38 hangs down from a joint portion of the retainer 37*a* and the guide 37*b*, and supports the rear portion of the paper P.

The rear support 38 has a generally U-shaped cross-section, and includes a depending portion 38*a*, a bottom portion 38*b*, a raised portion 38*c*, and a stopper 38*d*. The depending portion 38*a* depends from a portion of the retainer 37*a* near the guide 37*b*. The bottom portion 38*b* extends in a direction substantially parallel to the bottom portion 32*a*, and is substantially at a right angle with the depending portion 38*a*. The raised portion 38*c* is raised substantially upward from the rear end of the bottom portion 38*b* and extends in such a direction as to be farther away from the depending portion 38*a*. The free end portion of the raised portion 38*c* is inwardly bent substantially at a right angle to form the stopper 38*d* that extends forwardly of the raised portion 38*c* from the free end of the raised portion 38*c*. Thus, the depending portion 38*a*, bottom portion 38*b*, and raised portion 38*c* form a cage-like structure hanging from the joint portion of the retainer 37*a* and the guide 37*b*. 38*c* The raised portion 38*c* and stopper 38*d* cooperate with each other to support and align the trailing edge of the paper P more evenly. The paper P extends first downwardly from the stopper 38*d*, then substantially horizontally toward the body 103, and upwardly to the retainer 37*a*. The retainer 37*a* holds the paper P from above, so that the paper P extends rearwardly to gently loop back along the retainer 37*a*. The paper then extends downward, and is guided by the raised portion 32*b* so that the leading edge of the paper P extends through a space defined between the bottom portion 38*b* and lower receiving portion 32*a*. In other words, the paper P describes a generally gentle spiral curve as a whole.

As shown in FIGS. 4 and 6, the side guides 35 and 36 abut the side edge of the paper P, supported by the medium rear portion guide 32 at a position q1 and by the medium rear holding guide 38 at a position q2, thereby positioning the paper P in its widthwise direction. As shown in FIGS. 4 and 5, the feed guides 29 abut the both side edges of the paper P at positions q3, thereby positioning and guiding the paper in the traverse direction (i.e., direction perpendicular to the direction of advance of the paper P).

The operation of the medium tray 30 of the aforementioned configuration will be described.

Figure 7:
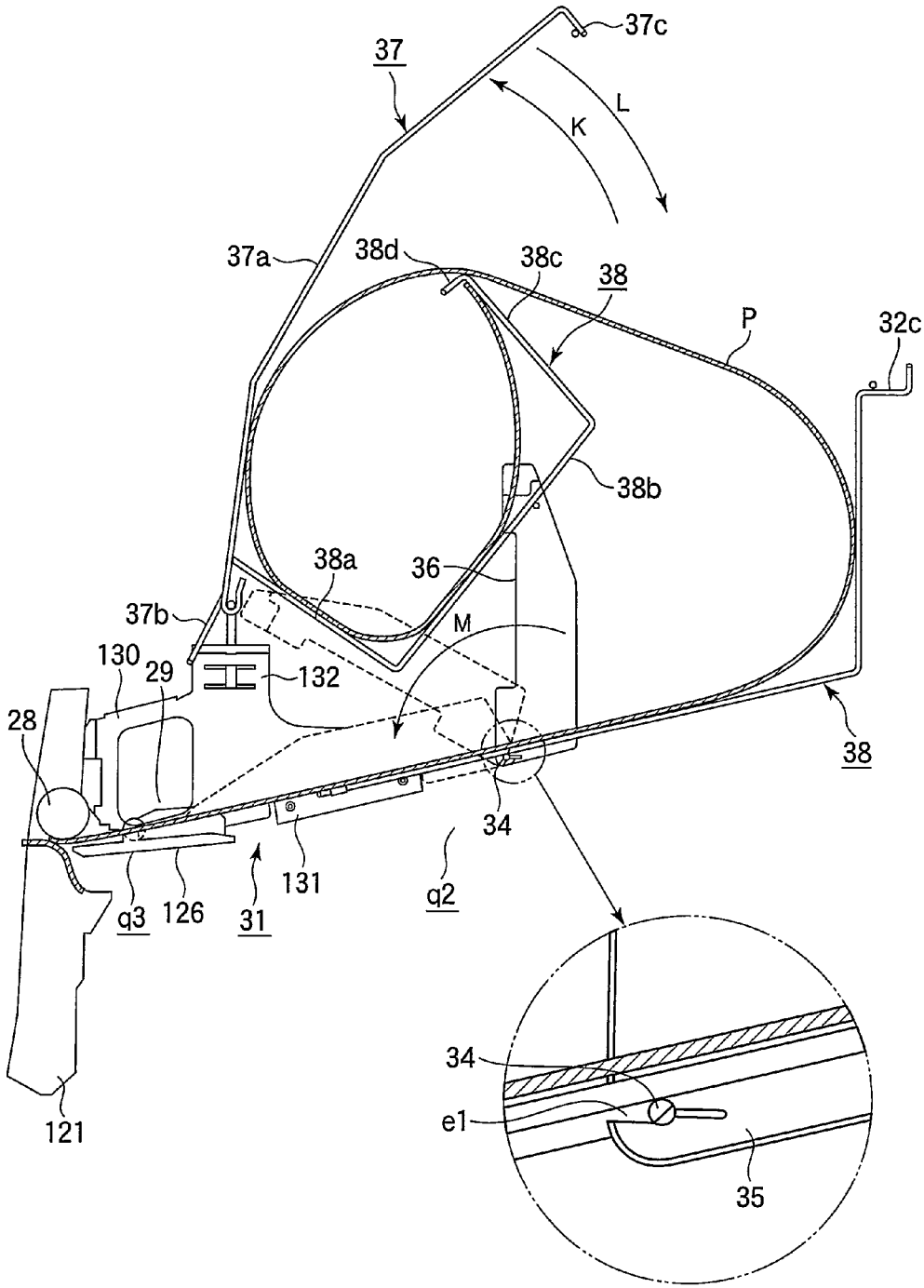
FIG. 7 illustrates the operation of the medium tray of the first embodiment.

FIG. 7 illustrates the operation of the medium tray 30 of the first embodiment.

The side guides 35 and 36 are pivoted to orient vertically. The upper guide 37 is pivoted in a direction shown by arrow K until the upper guide 37 is oriented generally vertically, thereby opening a space between the upper guide 37 and the medium rear portion guide 32.

Subsequently, the leading end portion of the paper P is allowed to enter the space until the paper P abuts the feed roller 28. The feed guides 29 are moved to abut the paper P.

After the feed guides 29 have abutted the paper P, the paper P is placed in the medium rear holding guide 38 such that the rear end of the paper P abuts, for example, the stopper 38*d*. Subsequently, the upper guide 37 is pivoted in a direction shown by arrow L (FIG. 7) so that the upper guide 37 is substantially parallel to the lower receiving portion 32*a* of the medium rear portion guide 32, thereby closing the space between the upper guide 37 and the medium rear portion guide 32. When the upper guide 37 is being pivoted, the paper P is, curled to describe a spiral along the medium rear holding guide 38. Then, the rear end 37*c* of the upper guides 37 abuts the support 32*c* of the medium rear portion guide 32, and then the upper guide 37 stops pivoting.

Depending on the length of the paper P, the paper P may be loaded such that the trailing edge of the paper P abuts the joint portion of the depending portion 38*a* and the bottom portion 38*b*, or the bottom portion 38*b* and the raised portion 38*c*.

One of the side guides 35 and 36, e.g., side guide 36, is pivoted in a direction shown by arrow M (FIG. 7) and is then moved in a traverse direction (i.e., a direction perpendicular to the direction of travel of the paper P) until the side guide 36 abuts one of the feed guide 29. Then, the other of the side guides 35 and 36, e.g., side guide 35, is pivoted in the M direction and is then moved in the traverse direction until the side guide 35 abuts the other of the feed guides 29. Thus, the paper P may be in its laterally centered position. The side guides 35 and 36 alleviate adverse effects of vibration on the paper P during the medium feeding operation, which would otherwise cause the paper to deviate from where it should be. The side guides 35 and 36 also reduce the chance of the paper P being skewed.

The shaft 34 is press-fitted into a cutout e1 formed in the side guides 35 and 36. The side guides 35 and 36 resiliently hold the shaft 34 in the groove e1 so that the gripping force exerted on the shaft 34 by the side guides 35 and 36 and the friction between the shaft 34 and the side guides 35 and 36 cooperate to hold the side guides 35 and 36 at any pivotal position relative to the shaft 34 including horizontal and vertical positions so that the side guides 35 and 36 may remain in contact with the feed guide 29 at any pivotal position. Instead of pressure and friction, the side guides 35 and 36 may be placed in position by another means.

Referring to FIGS. 4 and 6, the side guides 35 and 36 abut the side edge of the paper P from the middle portion of the paper P toward the trailing end of the paper P, while the feed guides 29 abut the side edge of the paper P from the middle portion of the paper P toward the leading end.

As described above, the side guides 35 and 36 and the feed guides 29 abut the paper P at three locations, i.e., forward portion (q3), middle portion (q2), and rearward portion (q1), thereby causing the paper P to be laterally centered. Therefore, even though the medium tray 30 has a structure having inaccurate dimensions formed by bending metal thin rods or bars into a cage-like shape and welding together, the paper P may still be maintained in position when the paper P shakes during feeding into the apparatus. The feed guides 29 and the side guides 35 and 36 may be positioned at an equal distance from the center of the width of the paper P positioned by the feed guides 29. The feed guides 29 abut the sides of the paper P at the forward portion, while the side guides 35 and 36 abut the sides of the paper P at the middle portion and rear portion of the paper P. Therefore, the paper P is prevented from being skewed, images not being skewed and print quality being improved.

In addition, the trailing end of the paper P is allowed to abut a predetermined part (e.g., stopper 38*d*) of the rear support 38 so that the trailing edge of the paper P are evenly aligned in an advance direction of the paper P. This is effective in preventing skew.

When the paper P is loaded into the medium tray 30, the side guides 35 and 36 are oriented vertically and guide the paper into the medium tray 30, thereby facilitating the loading of the paper P into the guide unit 129.

The side guides 35 and 36 are configured to pivot independently of each other. Alternatively, the side guides 35 and 36 may be coupled together via a coupling member so that operating one of the side guides 35 and 36 to pivot causes the other of the side guides 35 and 36 to pivot in an interlocking manner. The interlocking relation between the side guides 35 and 36 allows the user to operate the side guides 35 and 36 more smoothly and easily.

Still alternatively, the side guides 35 and 36 may be coupled together by means of a pinion-and-rack mechanism so that moving one of the side guides 35 and 36 causes the other of the side guides 35 and 36 to move in an interlocking manner. This further facilitates the operation of the side guides 35 and 36. If a pinion-and-rack mechanism is employed, the position between the feed guides 29 and the side guides 35 and 36 should be accurately maintained.

Comparison

A conventional medium tray for long size paper is mounted to, for example, the body of the printer.

Figure 8:
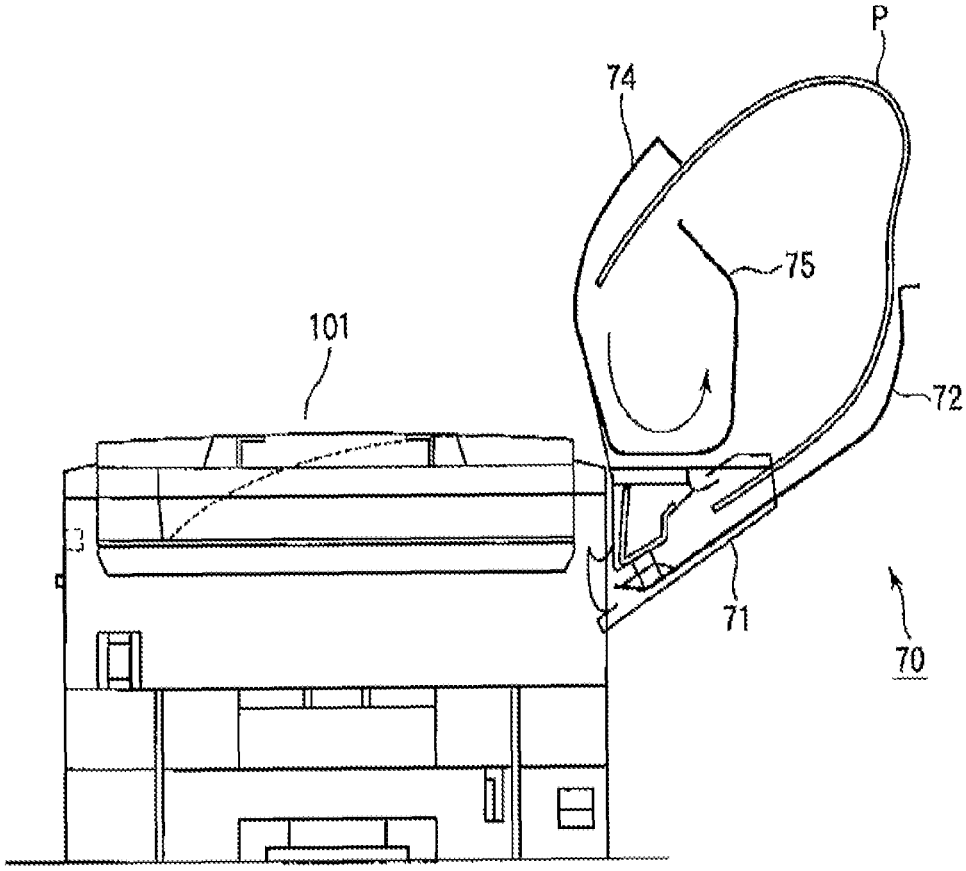
FIG.8 PRIOR ART
FIG. 8 illustrates a general configuration of a printer having a conventional medium tray.

FIG. 8 illustrates a general configuration of a printer having a conventional medium tray.

Referring to FIG. 8, the printer includes a body 101 and a medium tray 70. The medium tray 70 includes a platform 71, side guides 72, an upper guide 74, and a rear guide 75. The platform 71 is attached to a feed mechanism (not shown) of the body 101. The rear guide 72 extends upwardly to fold the rear end portion of paper P placed on the platform 71, thereby preventing the paper P from projecting outwardly.

The paper P is laterally centered only by a guide disposed at the feed mechanism. A user merely checks, by inspection, to determine whether the paper P is placed in position. Thus, the paper P may not be positioned accurately.

If the paper P is skewed in the medium tray 70, the image printed on the paper P is also skewed, resulting in poor print quality.

Second Embodiment

If the paper P placed in the medium tray 30 has a length shorter than a predetermined maximum length, the paper P may not be held in the guide unit 129 with the trailing edge of the paper P abutting the stopper 38*d* but may slide down somewhat due to gravity from where it should be. As a result, if a plurality of pages of the paper P is loaded in the guide unit 129, the weight of the paper P increases the friction between pages, preventing smooth paper feeding.

A second embodiment is to prevent the trailing end of the paper P from sliding down due to gravity. Elements similar to those of the first embodiment have been given the same reference numerals and the description of the operation and advantages of the same elements is omitted.

Figure 9:
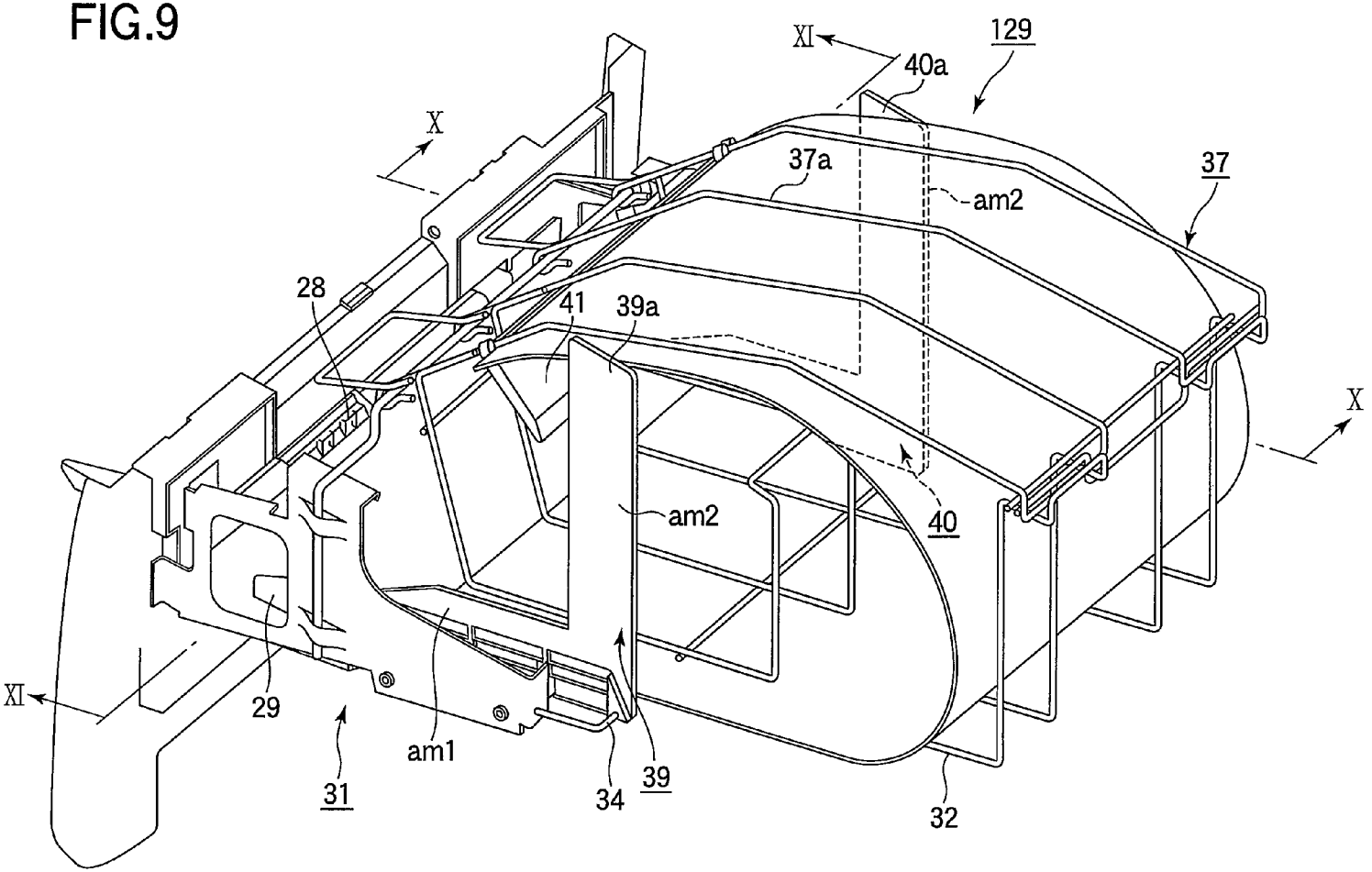
FIG. 9 is a perspective view of a medium tray of a second embodiment.

FIG. 9 is a perspective view of a medium tray of the second embodiment.

Figure 10:
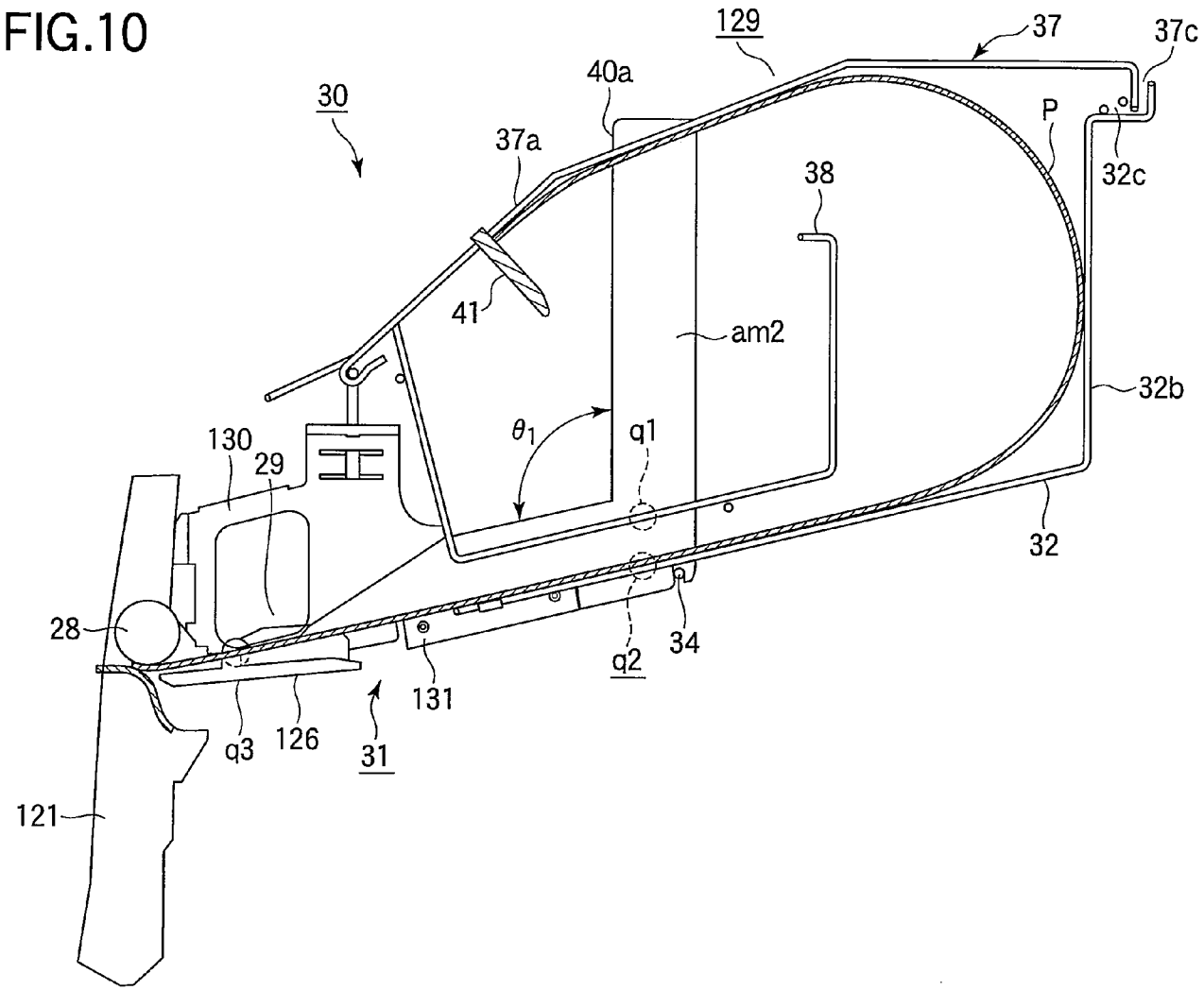
FIG. 10 is a cross-sectional view taken along a line X-X of FIG. 9.

FIG. 10 is a cross-sectional view taken along a line X-X of FIG. 9.

Figure 11:
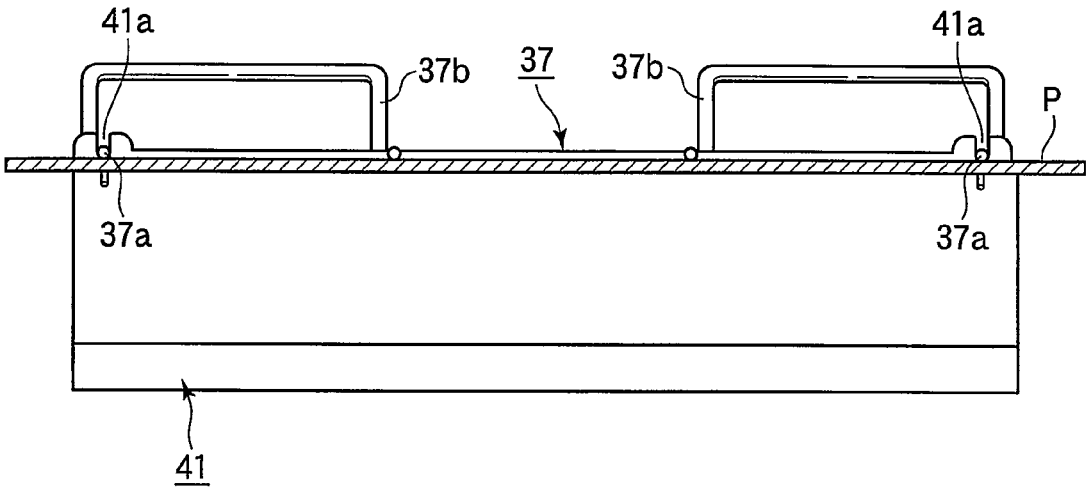
FIG. 11 is a cross-sectional view taken along a line XI-XI of FIG. 9.

FIG. 11 is a cross-sectional view taken along a line XI-XI of FIG. 9.

Side guides 39 and 40 are pivotally mounted on a shaft 34, and guide the paper P in a direction in which the paper P is advanced.

An upper guide 37 includes a retainer 37*a* causes the paper P to describe a loop. A tail stopper 41 is detachably mounted to the retainer 37*a*, being movable relative to the retainer 37*a*. The tail stopper 41 severs as a stopper that abuts the trialing edge of the paper P.

The tail stopper 41 includes a groove 41*a* into which a part of the retainer 37*a* is press-fitted.

The side guides 39 and 40 extend in a vertical plane such that the lower edges of the side guides 39 and 40 abut a supporting plate 131 (FIG. 3), and each include a first portion or an arm am1 and a second portion or an arm am2. The first portion am1 extends in a direction substantially parallel to a lower receiving portion 32*a*. The arm am2 extends from one end of the arm 1 to form an angle θ1 with respect to the arm am1, i.e., substantially in a direction of gravity in the embodiment. When the arm am1 is oriented in a direction substantially parallel to the lower receiving portion 32*a*, the arm am2 is nearly vertical to the lower receiving portion 32*a*. When the arm am1 is oriented nearly vertically, the arm am2 is nearly horizontal.

The angle θ1 is selected taking into consideration the position of the trailing edge of the paper P having a length shorter than a maximum length which is determined primarily by the design of the medium tray 30. The maximum length of the paper P is selected to be 1320 mm (52 inches) in the embodiment. If the paper P has a length of 900 mm (47 inches), the angle θ1 is selected taking into consideration the position of the trailing edge of the paper P having a length of 900 mm.

The operation of the medium tray 30 will be described.

The operation of the side guides 39 and 40 are the same as that of the side guides 35 and 36. The side guides 39 and 40 are pivoted until the arm am1 is oriented substantially vertically. Then, the upper guide 37 is pivoted until the upper guide 37 is substantially vertical, thereby opening a space between the medium rear portion guide 32 and upper guide 37 for loading the paper P in the medium tray 30.

Then, the leading edge of the paper P is inserted into the medium tray 30 through an opening formed between the upper guide 37 and the medium rear portion guide 32 so that the leading edge abuts the feed roller 28. Then, the feed guides 29 are moved till the medium guides 29 abut the side edges of the paper P.

After the feed guides 29 have abutted the side edges of the paper P, the upper guide 37 is pivoted until the upper guide 37 is substantially parallel to the lower receiving portion 32*a*, closing the space between the space between the medium rear portion guide 32 and upper guide 37. When the upper guide 37 is being pivoted, the paper P is caused to curl along a the rear support 38, and the trailing edge of the paper P abuts the tail stopper 41 that has been set at a predetermined position in accordance with the length of the paper P.

Subsequently, the side guides 39 and 40 are pivoted till the arm am1 is oriented horizontally, and is then moved in a traverse direction (i.e., a direction perpendicular to the direction of travel of the paper P) until the side guides 39 and 40 abut the feed guide 29. At this moment, the arm am2 is oriented vertically. In this manner, the arms am1 and am2 are movable.

With the aforementioned positional relations, as shown in FIGS. 9 and 10, the free end portions 39*a* and 40*a* of the arms am2 abut the side edges of the paper P near the trailing edge of the paper P. The lower end portions of the arms am2 abut side edges of the paper P at the middle portion of the paper P. The feed guides 29 abut the side edges of the paper P near the leading edge of the paper P.

Thus, the paper P is aligned in its widthwise direction by the side guides 39 and 40, and in its longitudinal direction by the tail stopper 41. When the rear end 37*c* of the upper guide 37 abuts the support 32*c* of the medium rear portion guide 32, the upper guide 37 stops pivoting.

In this manner, even when the paper P has a length shorter than a predetermined maximum length, the paper P may still be held at three locations, i.e., forward portion (q3), middle portion (q2), and rearward portion (q1), so that skew is prevented.

The trailing edge of the paper P is held in the guide unit 129, being prevented from somewhat sliding down due to gravity. Therefore, even if a plurality of pages of the paper P is loaded in the guide unit 129, the weight of the paper P does not increase the friction between the pages of the paper P facilitating smooth feeding of paper P.

Third Embodiment

Elements similar to those of the first and second embodiments have been given the same reference numerals. The description of the operations and advantages of the same or similar elements is omitted.

Figure 12:
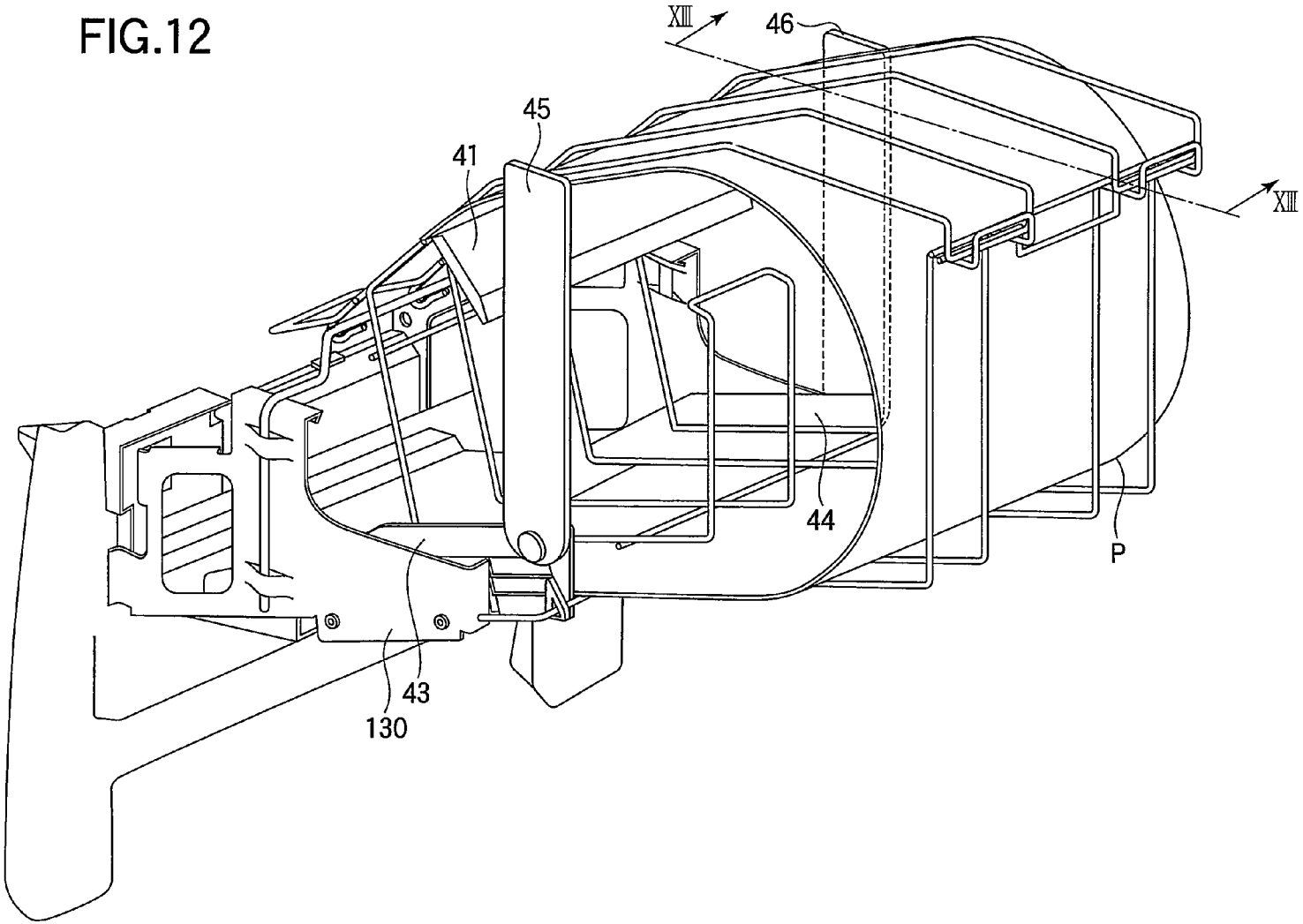
FIG. 12 is a perspective view of a medium tray of a third embodiment.
Figure 13:
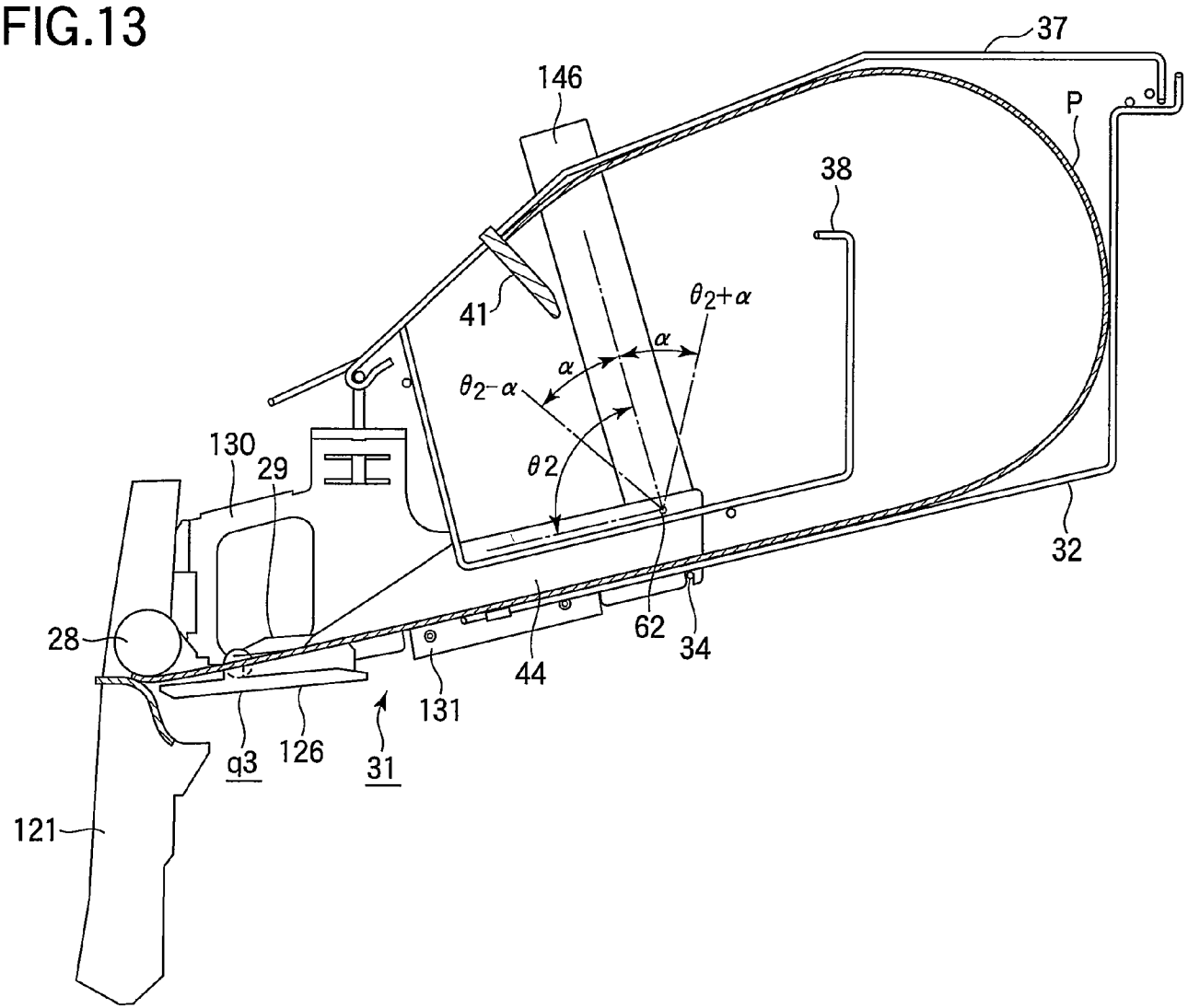
FIG. 13 is a cross-sectional view taken along a line XIII-XIII of FIG. 12.
Figure 14:
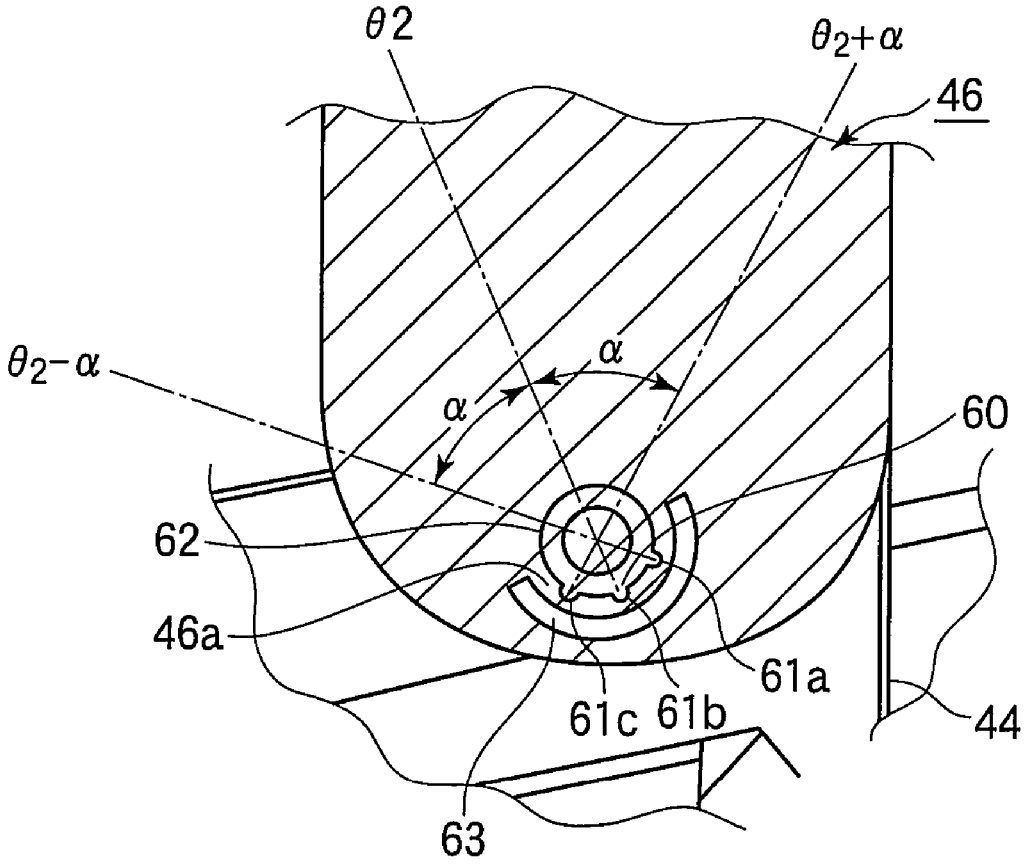
FIG. 14 illustrates the medium sub side guide of a third embodiment.
Figure 15:
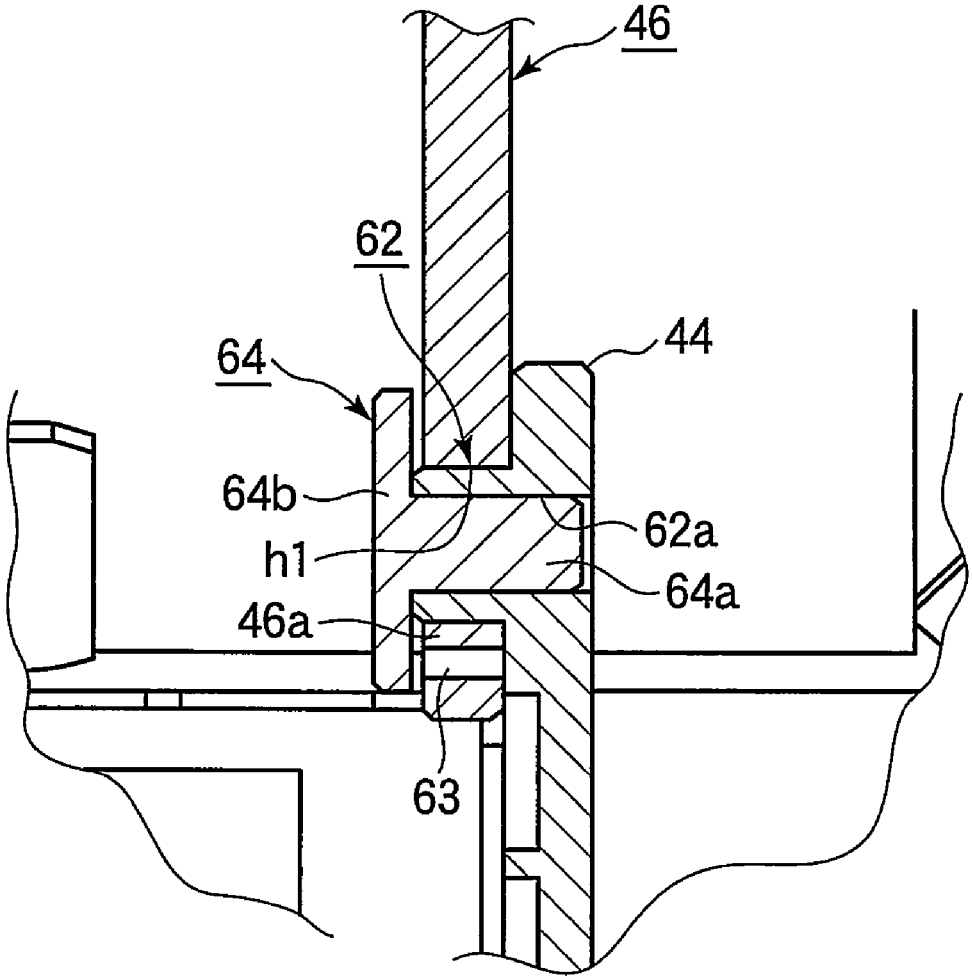
FIG. 15 is a cross-sectional view illustrating the medium sub guide of the third embodiment.

FIG. 12 is a perspective view of a medium tray of a third embodiment. FIG. 13 is a cross-sectional view taken along a line XIII-XIII of FIG. 12. FIG. 14 illustrates a medium sub side guide 46 of the third embodiment. FIG. 15 is a cross-sectional view illustrating the medium sub guide 46 of the third embodiment.

Medium sub side guides 45 and 46 are pivotally mounted to side guides 43 and 44, and may be retained at a desired position relative to the side guides 43 and 44.

Referring to FIGS. 13 and 14, the side guides 43 and 44 each include a medium sub side shaft 62 formed in one piece with the side guides 43 and 44. The medium sub side guides 45 and 46 are pivotally mounted on the corresponding medium sub side shafts 62, respectively. The medium sub side guides 45 and 46 may be positioned at three different positions to abut the sides of the paper P. In other words, the medium sub side guide 46 (45) is pivotal through an angle +α or −α from a position where the medium sub side guide 46 (45) forms an angle θ2 with the side guides 44 (43). Thus, the medium sub side guide 46 (45) may be positioned either at a forward position (θ2+α position), a reference position (θ2 position), or a rearward position (θ2−α position), and then fixed at a selected position.

Referring to FIGS. 14 and 15, the medium sub side guides 45 and 46 each include a hole hi formed therein through which the medium sub side shaft 62 extends, and an arcuate medium sub guide slit 63 substantially concentric to the hole h1. Thus, an arcuate bridge 46*a* is defined between the hole h1 and the medium sub guide slit 63. When a force in the radial direction is applied to the bridge 46*a*, the bridge 46*a* is somewhat resiliently deformed outwardly.

The arcuate bridge 46*a* includes three recesses 61*a*, 61*b*, and 61*c* formed in its radially inner surface substantially concentric to the hole h1. The medium sub side shaft 62 includes a projection 60 formed on its outer circumferential surface.

When the medium sub side guide 46 (45) is pivoted to the reference position, the projection 60 is received in the recess 61*b*. When the medium sub side guide 46 (45) is pivoted to the rearward position, the projection 60 is received in the recess 61*a*. When the medium sub side guide 46 (45) is pivoted to the forward position, the projection 60 is received in the recess 61*c*. In this manner, the medium sub side guide 46 (45) may be positioned either at the forward position, the rearward position, or the reference position.

When the medium sub side guide 46 (45) is pivoted, the projection 60 received in one of the recesses 61*a*-61*c* pushes the bridge 46*a* radially outwardly causing the bridge 46*a* to resiliently deform, and moves out of the one of the recesses 61*a*-61*c*. As the medium sub side guide 46 (45) is further pivoted, the projection 60 is received in another one of the recesses 61*a*-61*c* and the bridge 46*a* regains its original shape. The medium sub side guides 45 and 46 do not have to be either at the forward position (θ2+α position), reference position (θ2 position), or rearward position (θ2−α position), but may be positioned at any arbitrary position within a range from the forward position to the rearward position.

Referring to FIG. 15, the medium sub side shaft 62 includes a hole 62*a* that extends through the medium sub side shaft 62. A pin 64 includes a shaft portion 64*a* and a flange 64*b* that extends radially from the pin 64. The shaft portion 64*a* of the pin 64 is press-fitted into the hole 62*a*, so that the flange 64*b* prevents the medium sub side guide 46 (45) from dropping off the shaft 62.

The paper P is loaded into the medium tray 30, the trailing edge of the paper P abutting the tail stopper 41. The operation of the medium tray 30 will be described in terms of the paper P having a length of 900 mm. As long as the paper P has a length equal to or less than a maximum length that may be accepted in the medium tray 30, selecting the angular position of the medium sub side guides 45 and 46 in a range from the forward position (θ2−α position) to the rearward position (θ2+α position) accommodates the paper P having a variety of lengths including 900 mm.

The medium sub side guides 45 and 46 are positioned anywhere in the range of θ2±α so that the medium sub side guides 45 and 46 are in the vicinity of the trailing edge of the paper P loaded in the medium tray 30. In other words, when the medium sub side guides 45 and 46 are at the reference position, if the trailing edge of the paper P in the medium tray 30 is behind the medium sub side guides 45 and 46 (i.e., farther away from the apparatus 103 than the reference position), the medium sub side guides 45 and 46 are moved to the rearward position. If the trailing edge of the paper P in the medium tray 30 is ahead of the medium sub side guides 45 and 46 (i.e., closer to the apparatus 103 than the reference position), the medium sub side guides 45 and 46 are moved to the forward position.

As described above, the medium sub side guides 45 and 46 may be moved to an arbitrary position, allowing the paper P having an arbitrary length to be accurately positioned in the medium tray 30. This is effective in preventing skew.

Fourth Embodiment

Elements similar to those of the first to third embodiments have been given the same reference numerals. The description of the operations and advantages of the same or similar elements is omitted.

Figure 16:
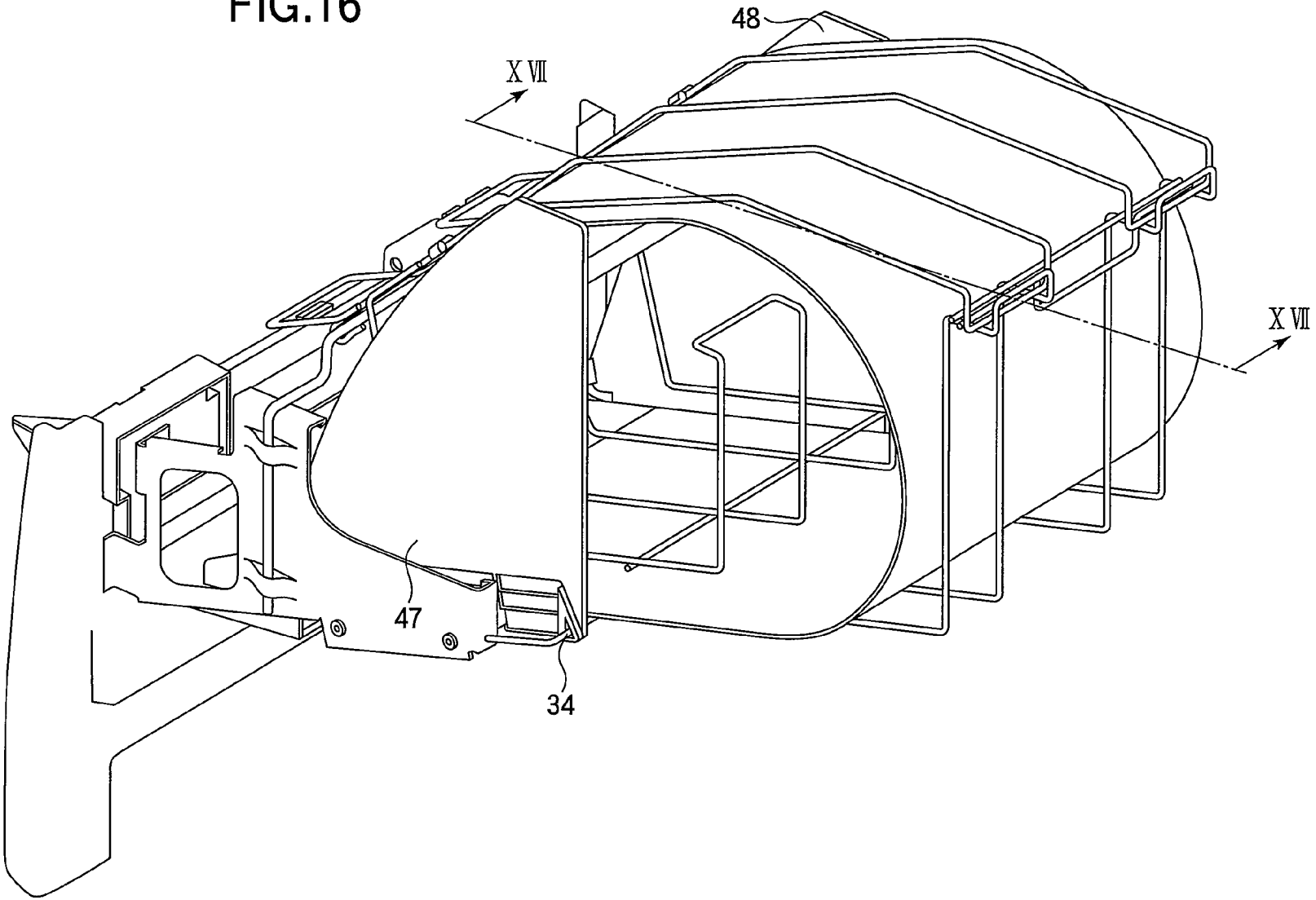
FIG. 16 is a perspective view of a medium tray of a fourth embodiment.
Figure 17:
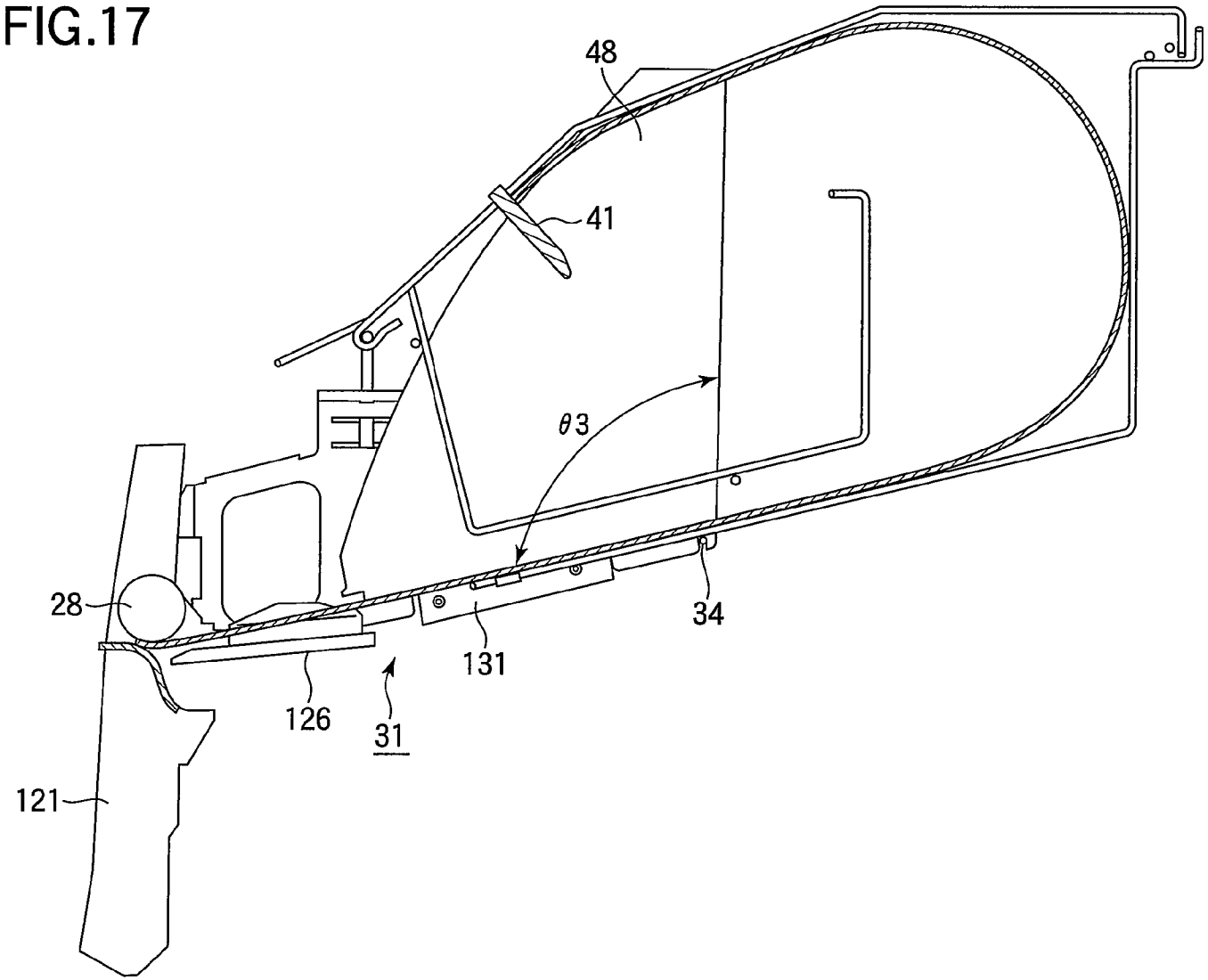
FIG. 17 is a cross-sectional view taken along a line XVII-XVII of FIG. 16.

FIG. 16 is a perspective view of a medium tray of a fourth embodiment. FIG. 17 is a cross-sectional view taken along a line XVII-XVII of FIG. 16.

Side guides 47 and 48 have a shape of a sector, and are pivotally mounted to a shaft 34, and may be retained at a desired position relative to the shaft 34. The angle θ3 of the sector is selected such that the side guides 47 and 48 abut the sides of the paper P near the trailing edge of the paper P when the paper P having a minimum length is loaded into the medium tray 30.

The operation of the medium tray 30 of the aforementioned configuration will be described.

The paper P is loaded into the medium tray 30, and the tail stopper 41 is positioned to abut the trailing edge of the paper P. Then, the side guides 47 and 48 are moved to a position where the side guides 47 and 48 abut the sides of the paper P near the trailing edge of the paper P.

The configuration of the fourth embodiment eliminates the medium sub side guides 45 and 46 of the third embodiment. Instead, only the side guides 47 and 48 are required for abutting the sides of the paper P near the trailing edge of the paper P when the paper P has a minimum length. In addition, the position of the side guides 47 and 48 may be adjusted in accordance with the length of the paper P. This increases the operability of the side guides 47 and 48.

The use of the sub side guides 45 and 46 of the third embodiment suffers from a drawback in that hingedly coupled guide members 43, 45, 44, and 46 may have a difference in angular position between a pair of guide mechanisms 43 and 45, and 44 and 46. In contrast, the use of side guides 47 and 48 eliminates the problem of using hingedly coupled guide members having a difference. In addition, there is no chance of the paper P being loosely loaded in the medium tray 30. Thus, not only the paper P may be accurately positioned but also skew is prevented. As a result, the images may be printed without skew and the quality of the images may be improved.

While the image forming apparatuses of the first to fourth embodiments have been described in terms of a printer, the present invention may be applicable to many other apparatuses including copying machines, facsimile machines, and multi function printers.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A medium holding apparatus detachably attached to a medium feeding section of an image forming apparatus, the medium holding apparatus comprising:

a supporting section that supports a medium thereon;

a side guide mounted to said supporting section and abutting a side edge of the medium to guide the medium toward the medium feeding section, said side guide extending in a direction parallel to a first direction in which the medium is advanced to the medium feeding section and being movable in a second direction substantially perpendicular to the first direction;

a guide unit mounted to said supporting section, wherein when the medium is fed to the image forming apparatus, the guide unit guides the medium to said supporting section while holding the medium in a gently curved position; and a stopper, including a groove, that engages a trailing edge of the medium, the stopper being detachably attached to the guide unit via the groove so as to be movable in the first direction relative to the guide unit.

2. The medium holding apparatus according to claim 1, wherein the stopper is disposed on the guide unit at a position in accordance with a length of the medium.

3. An image forming apparatus incorporating the medium holding apparatus according to claim 1.

4. The medium holding apparatus according to claim 1, wherein said side guide is in the shape of a sector.

5. The medium holding apparatus according to claim 1, wherein said side guide includes a first portion that extends substantially parallel to the first direction and a second portion that extends in a direction at an angle with respect to the first portion.

6. The medium holding apparatus according to claim 5, wherein the second portion guides the side edge of the medium at a location in the vicinity of a trailing edge of the medium.

7. The medium holding apparatus according to claim 1, wherein the supporting section has a shaft extending in said second direction and said side guide is pivotally mounted to said supporting section so that said side guide is allowed to pivot about said shaft.

8. The medium holding apparatus according to claim 7, wherein said side guide is a first side guide, wherein the medium holding apparatus comprises a second side guide, the first side guide and the second side guide being disposed on opposite sides of a transport path in which the medium advances, and guiding side edges of the medium at a longitudinal middle portion of the medium and a longitudinal end portion of the medium.

9. An image forming apparatus incorporating the medium holding apparatus according to claim 7.

10. The medium holding apparatus according to claim 7, wherein said side guide includes a first portion that extends substantially parallel to the first direction and a second portion that extends in a direction at an angle with respect to the first portion.

11. The medium holding apparatus according to claim 10, wherein the second portion guides the side edge of the medium at a location in the vicinity of a trailing edge of the medium.

12. A medium holding apparatus detachably attached to a medium feeding section of an image forming apparatus, the medium holding apparatus comprising:

a supporting section that supports a medium thereon;

a first side guide mounted to said supporting section and abutting a side edge of the medium to guide the medium toward the medium feeding section, said first side guide extending in a direction parallel to a first direction in which the medium is advanced to the medium feeding section and being movable in a second direction substantially perpendicular to the first direction, the first side guide having a first shaft extending in said second direction;

a second side guide having a second shaft extending in said second direction;

a guide unit mounted to said supporting section, wherein when the medium is fed to the image forming apparatus, the guide unit guides the medium to said supporting section while holding the medium in a gently curved position; and first and second medium sub side guides that are pivotally mounted to each of the first shaft and the second shaft respectively so as to be pivotable about the first shaft and the second shaft, wherein the first side guide and the second side guide are disposed on opposite sides of a transport path in which the medium advances, the first side guide and the second side guide guiding edges of the medium at a longitudinal middle portion of the medium and a longitudinal end portion of the medium.

13. An image forming apparatus incorporating the medium holding apparatus according to claim 12.

14. A medium holding apparatus detachably attached to a medium feeding section of an image forming apparatus, the medium holding apparatus comprising:

a supporting section that supports a medium thereon;

a side guide mounted to said supporting section and abutting a side edge of the medium to guide the medium toward the medium feeding section, said side guide extending in a direction parallel to a first direction in which the medium is advanced to the medium feeding section and being movable in a second direction substantially perpendicular to the first direction, the side guide having a shaft extending in the second direction;

a guide unit mounted to said supporting section, wherein when the medium is fed to the image forming apparatus, the guide unit guides the medium to said supporting section while holding the medium in a gently curved position; and a medium sub side guide pivotally mounted to said shaft so as to be pivotable about the shaft.

15. The medium holding apparatus according to claim 14, wherein the medium sub side guide includes an engagement portion that engages said shaft to hold the medium sub side guide at an angle relative to said side guide.

16. An image forming apparatus incorporating the medium holding apparatus according to claim 14.

* * * * *